United States Patent [19]

Wood

[11] Patent Number: 4,915,158

[45] **Date of Patent: * Apr. 10, 1990**

[54] BELT COMPOSITION FOR IMPROVING PERFORMANCE AND FLATNESS OF THIN REVOLVING ENDLESS FLEXIBLE CASTING BELTS IN CONTINUOUS METAL CASTING MACHINES

[75] Inventors: J. F. Barry Wood, Burlington, Vt.

[73] Assignee: Hazelett Strip-Casting Corporation, Colchester, Vt.

[ * ] Notice: The portion of the term of this patent subsequent to Jun. 7, 2005 has been disclaimed.

[21] Appl. No.: 203,249

[22] Filed: Jun. 6, 1988

Related U.S. Application Data

[63] Continuation of Ser. No. 118,404, Nov. 9, 1987, Pat. No. 4,749,027.

[51] Int. Cl.[4] ..... B22D 11/06

[52] U.S. Cl. ..... 164/431; 164/432

[58] Field of Search ..... 164/481, 482, 431, 432, 164/475, 485, 455, 415

[56] References Cited

U.S. PATENT DOCUMENTS 4,053,010 10/1977 Boccon-Gibod ..... 164/415

4,759,400 7/1988 Bessho et al. ..... 164/485

*Primary Examiner*—Kuang Y. Lin

*Attorney, Agent, or Firm*—Parmelee, Bollinger & Bramblett

[57] ABSTRACT

A method and belt composition for improving the performance and flatness of thin revolving flexible casting belts of continuous casting machines wherein at least one wall of the moving mold is provided by a thin flexible endless metallic casting belt having a permanent insulative coating with fluid-accessible porosity in this permanent coating. Contrary to prior methods and apparatus which have sought to protect the wide thin casting belts, the present method for improving belt flatness and performance involves providing a Helium-containing gaseous film between the metal and the front face of the casting belt which is coated with a permanent insulative porous coating. For significantly improved results, this gaseous film contains at least 8 percent and preferably 15 percent and optimally 20 percent or more of Helium by volume and is non-reactive with the metal being cast, resulting in a controlled increase in the rate of heat transfer and for causing such heat transfer to become more nearly uniform and stabilized across the width of the flexible casting belt than in prior continuous casting machines of the same moving mold cross-sectional shape and size. The freezing rate advantageously becomes stabilized at a substantially higher and more uniform rate, the belt flatness becomes stabilized and the cast metallic product is thereby substantially improved both in metallurgy and surface appearance. Also, copper or copper alloy casting belts are used in certain embodiments for enhancing heat-transfer effects and belt flatness. During casting at a given speed, the freezing rate and exit temperature of the metal being continuously cast can be controlled by varying the helium percentage in the gaseous film itself. In twin-belt machines, relative heat-transfer rates into upper and lower belts are controlled by adjusting the relative helium percentages in their respective gas films.

7 Claims, 5 Drawing Sheets

BELT COMPOSITION FOR IMPROVING PERFORMANCE AND FLATNESS OF THIN REVOLVING ENDLESS FLEXIBLE CASTING BELTS IN CONTINUOUS METAL CASTING MACHINES

This application is a continuation of copending application Ser. No. 118,404, filed Nov. 9, 1987, which will become issued as Pat. No. 4,749,027 on Jun. 7, 1988.

TECHNICAL FIELD

The present invention relates to enhancing the heat-transfer effects into and through the wide thin revolving flexible belts used to provide moving mold walls in continuous casting machines for casting ferrous and non-ferrous metals wherein the front surface of the belt which faces toward the metal being cast has a permanent, porous insulative belt coating having fluid-accessible porosity as defined in the above-referenced U.S. Pat. No. 4,588,021. More particularly, this invention is directed to improving belt flatness by increasing and controlling the rate of heat transfer from the metal being cast into the casting belt and by making such heat transfer more uniform and by stabilizing such heat transfer at a higher value being accomplished by providing a helium-containing gas film between the metal and the casting belt, such film being non-reactive with the metal being cast. Copper or copper alloy casting belts are used in certain embodiments for enhancing heat-transfer effects and for improving belt flatness. The metal freezing rate becomes stabilized at a higher rate and the metallic product is improved both in metallurgy and surface appearance.

BACKGROUND

In the prior art, efforts were made to minimize or reduce the rate of heat-transfer effects of the molten metal on the casting belts in continuous casting machines in order to protect these wide, thin, revolving flexible casting belts, especially to minimize their distortion, buckling, wrinkling, rippling, or fluting.

For such purposes, the temperature of the flexible casting belts in twin-belt casting machines was controllably elevated prior to contact with the metal being cast. For providing belt temperature elevation, heaters were directed at close range aganist the front (outer) faces of the casting belts before the belts came into contact with the molten metal. Also, hot fluid, such as steam, was circulated within hollow nip rolls at the entrance of the casting region to elevate the temperature of the casting belts. Further, the high velocity liquid coolant which serves to cool the reverse (inner) faces of the casting belts was directed onto these inner surfaces so that this cooling effect occurred only momentarily before or simultaneously with the contact of molten metal against the belt's front faces, as described and claimed in U.S. Pat. No. 4,082,101. Method and apparatus for belt temperature elevation are described and claimed in U.S. Pat. Nos. 3,937,270 and 4,002,197. In addition, casting belts were preheated by direct application of steam to their reverse surfaces before the endless belts entered the casting zone, thereby reducing the differential temperature of the belt before and after it entered the casting zone to thereby reduce distortion. Method and apparatus for such steam preheating are described and claimed in U.S. Pat. No. 4,537,243.

In order to reduce the rate of heat transfer into the revolving belts and travelling edge dams and to improve their durability to withstand thermal and mechanical stresses and to improve the cast product, casting belts and edge dam blocks were coated on their front surfaces with insulative and protective materials, for example as described and claimed in U.S. Pat. Nos. 3,871,905, 4,588,021, and 4,545,423. Pat. No. 4,588,021 describes a unitary-layer matrix belt coating having controlled porosity characteristics fusion bonded to a belt usually cold-rolled from low carbon steel and usually having a thickness in the range from about 0.035 of an inch up to about 0.065 of an inch. Some belts were also made from a titanium-containing steel, as described in U.S. Pat. No. 4,092,155, which is work hardened by cold rolling. The controlled fluid-accessible-porosity characteristics in the fusion-bonded matrix coating was taught as being desirable and important, to the effect that an appropriate level of such porosity contributes substantially to the insulative value and durability of the matrix coating, while at the same time such fluid-accessible porosity enhances the desired characteristics of relative non-wettability of the belt by molten metal. It was believed that this non-wetting enhancement is due in large part to the air retained in the interstitial pores of the porous coating. When molten metal is introduced adjacent to the coated belt, the air in the pores is heated and expands out of the pores and so supplies a gaseous film between the molten metal and the belt coating, thereby preventing the molten metal from wetting the coated belt during the critical initial time when a skin of solidfied metal is being formed on the product being cast in the continuous casting process.

A machine for producing an insulative and protective coating on a wide thin endless revolving flexible casting belt and a thermal spray gun traversing apparatus and system for laterally tracking a revolving casting belt being thermally spray coated are described and claimed in U.S. Pat. Nos. 4,487,157 and 4,487,790.

In U.S. Pat. Nos. 4,593,742 and 4,648,438 described and claimed a method and apparatus for protecting the molten metal surface within the mold cavity from oxygen and other detrimental atmospheric gases, hydrogen or water vapor, sulphuric gases or carbonic acid gas by injecting into the mold and applying to the moving mold surfaces an inert gas. As suitable shielding gases, being inert and essentially nonreactive in relation to the metal being cast, nitrogen, argon or carbon dioxide are described. In addition, it was suggested to use a lighter-than-air gas below the casting metal in the mold and a heavier-than-air gas above the casting metal. As a lighter-than-air gas nitrogen was mentioned, which is about 3 percent lighter than air. As a heavier-than-air gas argon was mentioned, which is about 35 percent heavier than air.

In twin-belt continuous metal casting machines, particularly for casting copper, the travelling side (edge) dams have been formed by stringing slotted damblocks along the entire length of a flexible metal strap, all blocks being free to slide along the strap. These blocks were cooled by controlled coolant sprays in a chamber, their temperature after cooling was sensed, and then an insulative material was applied to the damblocks before re-entry into the casting zone. The damblocks were preferably made of a bronze alloy which presented a better resistance to heat crackling and a higher heat conductivity than the nickel-chromium steel damblocks previously used for casting copper. This damblock alloy was "Bronze Corson," a trademark of Usines a Cuivre et a Zinc de Liege, and has a composition of 1.5 to 2.5% Nickel, 0.4 to 0.9% Silicon, 0.1 to 0.3% Iron, 0.1 to 0.5% Chromium, balance Copper. These damblocks conducted heat rapidly away from the two side surfaces of the cast copper bar product. This method and apparatus for continuously casting a copper bar product using such "Bronze Corson" alloy damblocks is described and claimed in U.S. Pat. No. 4,155,396.

The problems of belt distortion, buckling, wrinkling, rippling or fluting are more pronounced near the entrance to the mold, usually within about 15 to 20 inches (about 38 to 51 centimeters) of the line of tangency of the belt with the pulley roll at the mold entrance, as is illustrated in FIG. 8 of U.S. Pat. Nos. 3,937,270 and 4,002,197.

In casting Aluminum, the experience over the past several years has shown that relatively pure Aluminum and Aluminum Alloys having narrow ranges of solidification temperatures, i.e., narrow ranges of no more than about 15° C. are continuously castable in twin-belt casting machines to commercially acceptable specifications without undue complications. However, Aluminum Alloys having wider ranges of solidification temperatures above about 40° C. are found to be much more difficult to continuously cast to commercially acceptable specifications.

All of the above referenced patents are assigned to the same assignee as the present application. The disclosures of all of the foregoing patents are incorporated herein by reference.

SUMMARY OF THE DISCLOSURE

Among the objects of this invention are to provide a new and improved method and a novel casting belt for casting molten metal in continuous casting machines having moving molds wherein at least one wall of the moving mold is provided by a thin, revolving, flexible endless metallic casting belt having a permanent insulative porous coating with fluid-accessible porosity.

Other objects are to improve the metallurgy of cast product and to improve the surface appearance of the cast product produced in continuous casting machines having wide, thin, revolving, flexible endless casting belts providing one or more of the moving mold walls. An additional object is to increase the rate of casting production.

The present inventors have found that the problems of buckling, rippling, wrinkling or fluting of the wide, thin, revolving, endless, flexible casting belts arising from temperature gradients over the belt surfaces and through the belts can be minimized surprisingly by enhancing heat transfer, particularly with regard to the upper and lower belts in twin-belt casting machines. This basic concept of the present invention is completely different from and contrary to the prior-art principles wherein the thermal insulation was kept high in order to protect these casting belts; i.e. an insulative matrix coating was thermally sprayed onto and bonded to the front surface of the belt, and this matrix coating was intentionally made with fluid-accessible porosity so that air was retained in the pores and, when heated and expanded, supplied an insulative gaseous film between the molten metal and the belt coating.

In accordance with the present invention, in one of its aspects, the gaseous film which is provided between the metal being cast and the casting belt has a high thermal conductivity, so that heat is conducted more rapidly and more uniformly through this high conductivity gaseous film. The inventors have found that the rate of heat transfer and the dynamics of the casting process, plus the metallurgy of the cast product and its surface appearance, are markedly improved by using a helium-containing gas for providing the gaseous film.

The heat conductivity of various gaseous are set forth on page 1868 of the Handbook of Chemistry and Physics, Thirtieth Edition, 1947, by Chemical Rubber Publishing Co. The various values for Air, Nitrogen, Argon, Carbon Dioxide, and Helium in appear as follows:

| | |
|---|---|
| Air, 0° C. | 0.0000568 |
| Nitrogen, 7°-8° C. | 0.0000524 |
| Argon, 0° C. | 0.0000389 |
| Carbon Dioxide, 0° C. | 0.0000307 |
| Helium, 0° C. | 0.000339 |

The significance is not in the absolute magnitudes or precision of these values but in the relative heat conductivity of Helium as compared with the heat conductivity of these other gases. The heat conductivity of Helium is seen to be about 6 times as large as Air, about 6.5 times as large as Nitrogen, about 8.7 times as large Argon and about 11 times as large as Carbon Dioxide.

Contrary to prior methods and apparatus which sought to protect the wide, thin, revolving, flexible casting belts by inhibiting transfer of heat from the molten metal into the casting belts, the present invention by enhancing such heat transfer surprisingly (1) improves belt flatness; (2) improves metallurgy of the cast product; (3) improves surface appearance of the cast product; (4) considerably increases the production rate of the cast product; plus (5) provides more ways to control continuous casting dynamics. Since the gaseous film adjacent to the metal being cast is, in the prior art, the largest factor in inhibiting heat transfer from the metal being cast to the casting belt, the provision of a Helium-containing gaseous film which is non-reactive with the metal (6) dramatically increases this heat-transfer rate and (7) renders this increased heat-transfer rate more nearly uniform across the width of the surface area of the metal being frozen and surprisingly results in the advantages enumerated above.

The terms "enhanced heat transfer" or "enhancing of the heat transfer" or "enhancement of the heat transfer," as used herein, are intended to include concepts: (i) increasing the rate of heat transfer and/or (ii) rendering this increased rate of heat transfer more nearly uniform across the width of the surface area of the metal being cast and/or increasing the freezing rate and thereby improving the metallurgy of the cast product and/or improving the surface appearance of the cast product and/or increasing the production rate of the cast product in kilograms per hour —as compared with the same product in the same size, shape and type of moving mold without employing the present invention.

The term "a heat-transfer-enhancement-effective percentage by volume-amount of Helium" means a percentage amount by volume of Helium in a Helium-containing gaseous film between the metal being cast and the moving casting belt in a moving casting belt mold which is effective to provide enhancement of the heat transfer.

In accordance with the present invention, in another of its aspects, the flatness of the wide, thin, revolving, flexible casting belts is surprisingly improved and the cast product is improved in metallurgy, surface appearance and in tonnage output per hour by using such belts made of material having considerably higher thermal conductivity than the steel belt compositions previously used, so that transmission through the belt becomes larger per second as thermal gradients through the belt are reduced, as compared with steel belt compositions of the prior art.

In accordance with the present invention, in yet another of its aspects, the flatness of the wide, thin, revolving flexible casting belts is surprisingly improved and the cast product is improved in metallurgy, surface appearance and in tonnage output per hour by using such belts made of material having a considerably lower Young's modulus of elasticity and a considerably lower modulus of rigidity than the steel belt compositions of the prior art.

The inventors have found that by using wide, thin, revolving, flexible casting belts made from high Copper Alloy compositions, the surprising improvements indicated in the previous two paragraphs are advantageously achieved, and the interface temperatures between the surface area of the metal being cast and the casting belts could be decreased.

Although it was known that Copper has a higher thermal conductivity than Steel or Iron, there was a prejudice against using Copper. Firstly, it has been assumed previously that, in thin casting belts, a high insulativity is better than a lower one. Secondly, Steel was used because it was assumed that it has a better durability under the conditions of use and is stronger for resisting the relatively enormous belt tensions employed in twin-belt continuous casting machines; for example, tension forces higher than 10,000 pounds per square inch of belt cross-sectional area are routinely applied to each belt.

Previously it was only suggested to use Copper Alloy as a material for the damblocks in a twin-belt continuous metal-casting machine. However, these bulky, rectangular blocks have completely different functions from the wide, thin, flexible casting belts, and the mechanical dimensions of such damblocks are radically different from the dimensions of these flexible belts. In particular, the casting belts are revolving and flexing under relatively enormous tensile forces and flexural stresses; whereas the damblocks are pressed together against each other in compression so that there is no space between the damblocks in the casting zone for avoiding leakage or "flashing" of molten metal between damblocks. For example, a specification for Copper Alloy damblocks of typical medium size is 2.36 inches (60 mm) in height, 1.97 inches (50 mm) in transverse width and 1.57 inches (40 mm) in the direction of casting; whereas metallic casting belts, wide and thin as they are, typically have a thickness in the range from 0.035 of an inch (0.89 mm) up to 0.065 of an inch (1.65 mm) and a width up to 76 inches (1,930 mm) or more or less, depending upon the width of the twin-belt continuous casting machine, and an endless flexible belt length of 340 inches more or less, varying considerably with the twin-belt caster's length.

As indicated above, the Young's modulus of elasticity of Copper or a high Copper Alloy composition is less that that for Steel. The modulus of elasticity for Copper and high Copper alloys, i.e. more than 85% Cu by weight, is in the range of about 15 to about $18\times10^6$ lbs. per square inch (about 10.3 to about $12.4\times10^6$ Newtons per sq. cm.), whereas for Steel the Young's modulus of elasticity is about $30\times10^6$ lbs. per sq. in. (about $21\times10^6$ Newtons per sq. cm. )

(One of the surprising discoveries which has recently occurred to us is that the yield strength of a casting belt made of work-hardened Copper or high Copper Alloy does approach the yield strength of the typical casting belt made from standard low-Carbon Steel, and consequently, there is more elastic stretchability available for Copper or high Copper Alloy casting belts under an applied tension than for the typical prior-art steel belts.)

One would think that Copper as a casting belt material would be undesirable because of weakness and its higher coefficient of thermal expansion. Flexible casting belts are routinely operated at a tension in excess of 10,000 pounds per square inch as mentioned previously. The coefficient of thermal expansion for Copper at 100° C. is reported as $17.4\times10^{-6}$/degree C., in contrast to that of low-carbon steel, which is reported as $13.0\times10^{-6}$/degree C. at the same temperature, which temperature is representative of an average believed to exist during casting; that is, at 100° C., Copper is about 4/3 as thermally expansive as steel. In our tests, at least, it is indicated that, in spite of the somewhat higher coefficient of thermal expansion of Copper, the actual thermal expansion of a Copper belt under the conditions of continuous casting is less than that of a Steel belt, since the average temperature of the Copper belt under such conditions is evidently more uniform than that of a Steel belt and lower on the side toward the molten metal. Moreover, by virtue of the lower Young's modulus of elasticity of Copper, there results less differential thermally induced bending moment through the thickness of the belt, since thermally induced attempted expansion thereby translates into less magnitude of force, due to the significantly lower E for Cu.

The various additional features, aspects, advantages and objects of the present invention will become more fully understood from a consideration of the following detailed description of presently preferred embodiments, together with the accompanying drawings, which are not drawn to scale but rather are arranged for clarity of illustration and explanation.

DETAILED DESCRIPTION OF PREFERRED EMBODIMENTS

Figure 1:
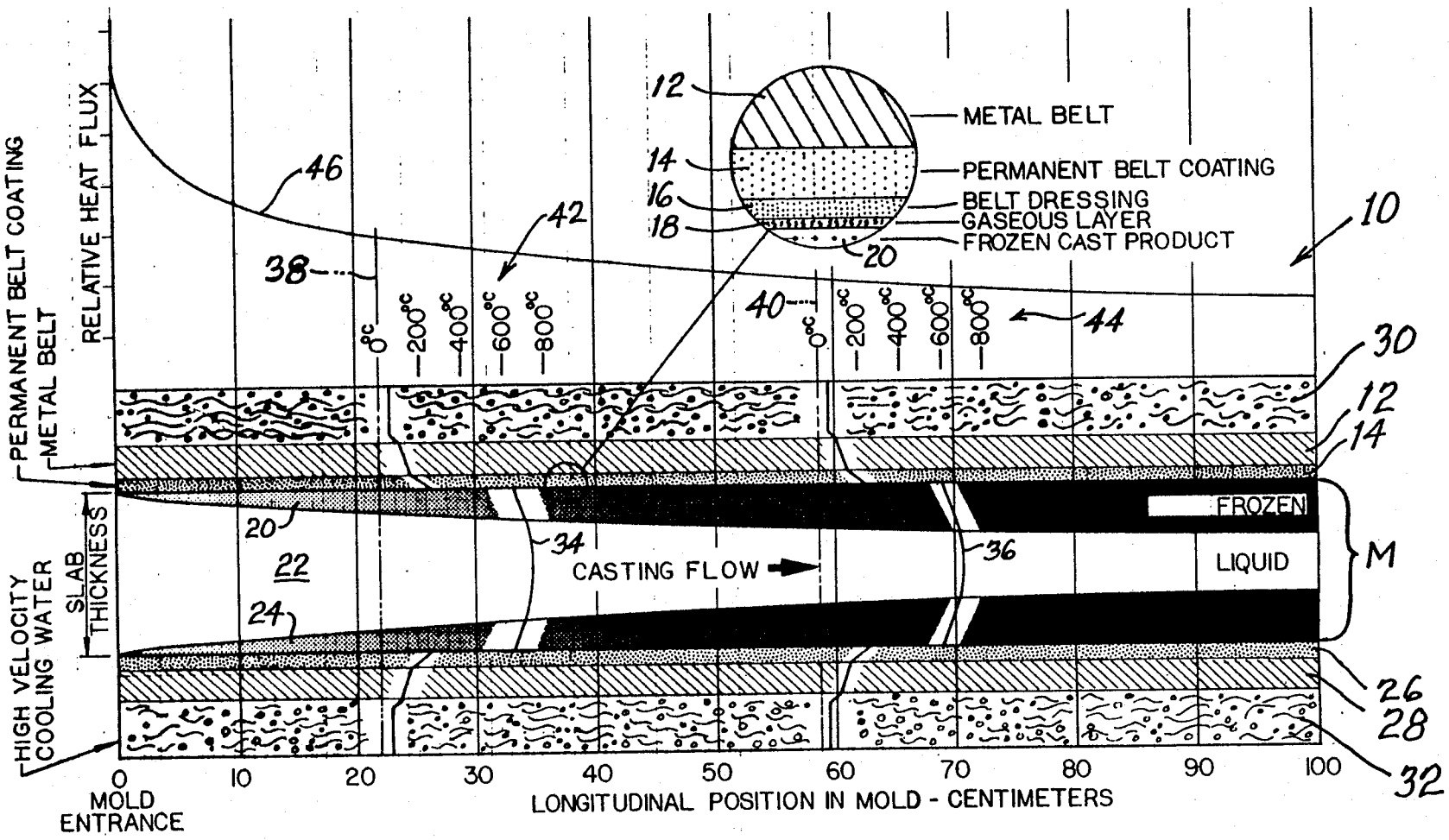
FIG. 1 (PRIOR ART)
FIG. 1 is a schematic elevational sectional view taken longitudinally, i.e. in the upstream/downstream direction, along the centerline of the moving mold in a twin-belt continuous metal casting machine, showing about 20 percent of the mold length not far from the entrance of the mold. The vertical scale of the Figure has been considerably enlarged at places, relative to the horizontal scale, for clarity of illustration and explanation. Superimposed on this drawing are two analytically estimated calculated curves (or plots) of temperature; these curves extend through the moving mold in the upward/downward direction. We believe this drawing to be reasonably representative of the conditions and temperature gradients in the mold when Nitrogen is used for shrouding the molten metal, as described and claimed in U.S. Pat. Nos. 4,593,742 and 4,648,438 reference above. Although the moving mold is there shown as horizontal, it is to be understood that such a mold is most often sloped downwardly in the downstream ("CASTING FLOW") direction.

With reference to FIG. 1, the direction of travel of the twin-belt moving mold 10 and of the metal "M" being cast is toward the right ("CASTING FLOW"). The moving mold 10 is defined by an upper wide, thin, revolving flexible Steel belt 12 coated on its front (lower) surface with a permanent matrix coating 14 fusion-bonded to the belt 12 and having fluid-accessible porosity as described and claimed in U.S. Pat. No. 4,588,021 referenced above in the BACKGROUND section. This permanent belt coating 14 is covered by a dry porous belt dressing 16 (please see the inserted enlargement in the drawing), having thereon an inert gaseous film or layer 18, for example of Nitrogen. The metal M being cast, for example to form a cast slab of Aluminum, includes an upper skin or shell 20 of solidified (frozen) cast product, an interior core of molten (liquid) metal 22 and a lower skin or shell 24 of solidified (frozen) cast product. It is to be noted that the thickness of the frozen portions 20 and 24 progressively increase in the direction of casting flow, while the thickness of the liquid core 22 correspondingly progressively decreases. Below the lower skin or shell 24 is a lower gaseous film or layer (not shown) similar to the upper film or layer 18, and then a dry porous belt dressing (not shown) covering a permanent matrix coating 26 fusion bonded to the front (upper) surface of a lower wide, thin, revolving flexible casting belt 28.

In accordance with the prior art, the casting belts 12 and 28 were fabricated from steel to provide physical toughness and resistance to stress and strain as well as resistance to the relatively enormous tension forces employed and resistance to the differential stresses undergone during continuous casting.

In order to cool the reverse surfaces of the casting belts 12 and 28 for solidifying the metal M, high velocity liquid coolant, namely water, often containing corrosion inhibitors, is applied and maintained along the reverse surfaces of the casting belts 12, 28, namely along the upper surface of the upper casting belt 12 and the lower surface of the lower casting belt 28, as is well known in the prior art. The upper belt coolant is indicated at 30, and the lower belt coolant at 32.

First and second analytically estimated and calculated curves (or plots) of temperature are drawn at 34 and 36, respectively. These temperature plots 34, 36 are drawn extending upwardly/downwardly, i.e., in the direction generally perpendicular to the casting flow direction, through the moving mold 10. The first temperature plot 34 is calculated to be representative of temperature conditions along a first plane 38 (shown by a dash-and-dotted line) extending perpendicular to the casting flow direction. This first plane 38 is located about 20 to 25 centimeters (about 8 to 10 inches) downstream from the mold entrance, which is shown at the zero centimeter position on the centimeter scale extending along the bottom of the drawing. The temperature scale for this plot 34 is shown in the region 42 of the drawing, and this temperature scale 42 extends to the right of the plane 38 above the upper coolant layer 30, with the 0° C. point of the temperature scale 42 being located on the plane 38.

The second temperature plot 36 is calculated to be representative of temperature conditions along a second plane 40 (shown by a dash-and-dotted line) extending perpendicular to the casting flow direction. This second plane 40 is located about 55 to 65 centimeters (about 21 to 25 inches) downstream from the mold entrance. The temperature scale for this second plot 36 is shown in the region 44 of the drawing, and this second temperature scale 44 extends to the right of the plane 40, with the 0° C. point being located on the plane 40.

For providing the reader with a better appreciation and understanding of the temperature dynamics in such a twin-belt moving mold 10, a relative heat flux curve 46 is plotted along the top portion of the drawing. The relative heat flux is greatest near the mold entrance, where the molten metal is being introduced, and progressively decreases in the downstream direction. The slope and shape of this curve 46 will vary depending upon the moving mold characteristics and upon the particular metal M being cast, its entering temperature, alloy composition, solidification temperature range, specific heat as a liquid and specific heat as a solid, latent heat released during freezing, casting rate, and so forth. However, it is to be understood that this curve 46 is generally representative of the temperature conditions encountered to date in such a twin-belt moving mold in casting a variety of metals and alloys, and is particularly representative when casting a slab of Aluminum or Aluminum Alloy.

Figure 2:
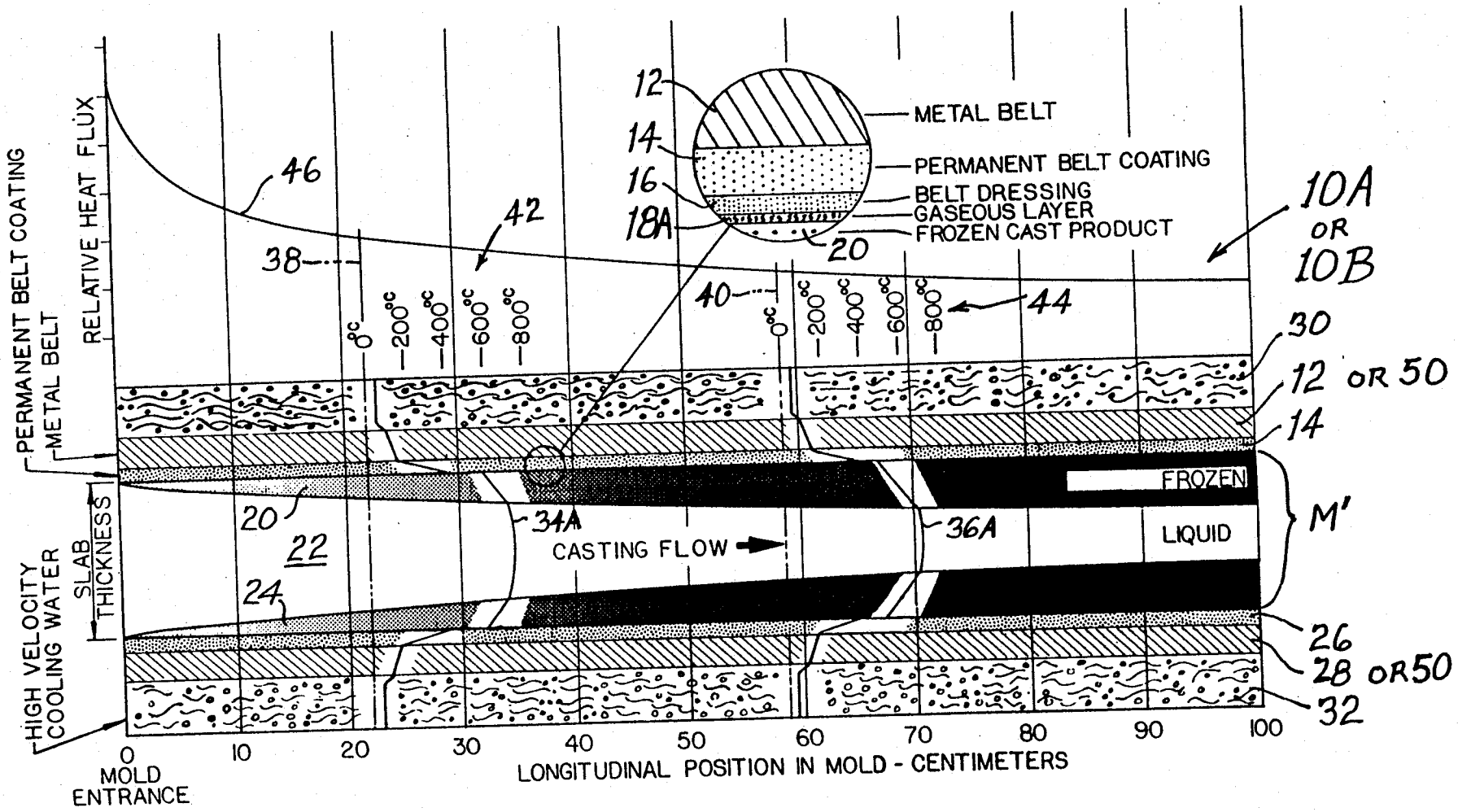
FIG. 2 is similar to FIG. 1, except that FIG. 2 shows the analytically estimated calculated conditions and two curves (or plots) of temperature which we believe to be reasonably representative when a Helium-containing gaseous film non-reactive with the metal being cast is provided between the metal being cast and the wide, thin, revolving, flexible casting belts.

The twin-belt moving mold 10A shown in FIG. 2 is identical with that shown in FIG. 1, except that the gaseous layer or film 18A provided between each surface of the metal M' and each casting belt in FIG. 2 is Helium-containing and non-reactive with the metal M' being cast—for example an Aluminum or Aluminum Alloy slab. The reference M' is used in FIG. 2 for indicating that the cast metal slab is improved in metallurgy and in surface appearance as compared with the prior-art cast metal M in FIG. 1. For example, the gaseous film or layer 18A is mainly dry Nitrogen mixed with 25% Helium by volume. It is to be understood that a similar Helium-containing inert gaseous layer (not shown) is provided between the metal M' and the lower casting belt.

In one method for providing the Helium-containing inert gaseous layer or film 18A between each surface of the metal M' and each casting belt, the Helium-containing inert gas is entrained with the porous permanent belt coating 14 and the porous dry belt dressing 16 as the casting belt enters the moving mold, as described in connection with FIGS. 3, 4, and 9 of the above-reference Pat. Nos. 4,593,742 and 4,648,438.

In another method for providing the Helium-containing inert gaseous layer or film 18A between each surface of the metal M' being cast and each casting belt, the Helium-containing inert gas is injected so as to be above and/or below the metal entering the moving mold 10A as described with reference to FIG. 6 or FIGS. 7 and 8 of the above-referenced patents, while also being entrained with the permanent belt casting 14 and belt dressing 16 as described with reference to FIGS. 3, 4 and 9 of said two patents.

For significantly improved results, the Helium-containing dry inert gas 18A is at least about 8% dry Helium by volume and is preferred to be at least 15% dry Helium by volume and optimally at least 20% dry Helium by volume. The temperature plots 34A and 36A are representative of a Helium-containing dry inert gas which is about 25% dry Helium by volume. The preferred main component of this Helium-containing gas is either Nitrogen, Argon or Carbon Dioxide, with Nitrogen being most preferred in the continuous casting of Aluminum.

In mixing Helium with another of these gases, it is very important to be critically aware that the relatively low density of Helium will unexpectedly affect the calibration of an annular-orifice ball flowmeter, thereby causing the meter to read "low"; i.e. there will likely be a faster flow (and consequently greater volume) of Helium in the resulting mixture than the indicated value given by such a ball flow-meter as compared with the indicated value given by an identical ball flowmeter simultaneously being used to measure the flow of Nitrogen, Argon, or Carbon Dioxide. The blending of dry Helium with dry Nitrogen, Argon or Carbon Dioxide is accomplished with a pair of pressure-tank regulators and a pair of ball and annular-orifice (ball-and-tapered-tube) flowmeters (not shown). This blending may be automatically controlled for providing the advantages described later.

The belt dressing or parting agent 16 should be dry, porous, and non-wetting in relation to the metal being cast, in accord with the present invention. We have concluded that natural or synthetic oils, which are often applied by those skilled in the prior art as an insulative barrier in such twin-belt moving molds 10, as shown in FIG. 1, tend to generate gases when contacted by molten metal. Hydrogen is apt to be released by the thermal breakdown of such oils into gases. Hydrogen can be absorbed by the hot metal, where it induces brittleness and porosity. Further, we have concluded that the evolution of various gases from oils evidently prevents or impedes the entry into the mold 10A or 10B of the desired Helium-containing gaseous film 18A. The fluid-accessible porosity in the permanent belt coating 14 and the porosity of the dry belt dressing 16 advantageously assist in entraining and adsorbing the Helium-containing gaseous film or layer 18A for carrying it into the mold.

Among those dry belt dressings 16 which are presently preferred in connection with the present invention are the "dry" (non-oil) dressings 16 (sometimes called "topcoats") which can be applied and continuously adjusted during casting, for example Carbon in the form of Acetylene Soot applied by means of Oxygen-starved Acetylene flames. The application of this dry belt dressing 16 may be continuous or intermittent or intermittently adjusted. Other suitable dry belt dressings 16 are Graphite or carbonaceous materials, which may contain additionally Molybdenum Disulphide, whose slipperiness enables the barely frozen skin 20, 24, or shell of the Aluminum Alloy slab M' to shrink thermally under reduced friction for reducing stress on intergranular eutectic as yet unfrozen.

It is to be noted that the calculated temperature plots 34A and 36A in FIG. 2 are advantageously remarkably different from the temperature plots 34 and 36, respectively, in FIG. 1, as will be described in detail later.

Figure 3:
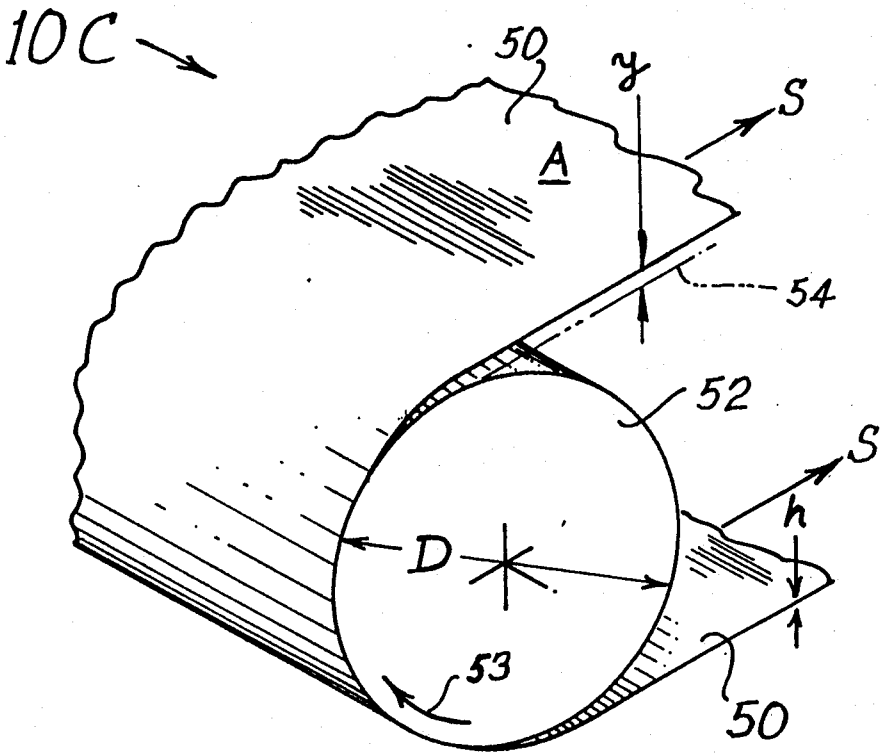
FIG. 3 is a partial perspective and simplified view of a pulley and belt passing around this pulley in a twin-belt casting machine, showing the belt takeoff effect due to rigidity in bending of the belt.

The twin-belt moving mold 10B also shown in FIG. 2 is identical with the twin-belt moving mold 10A already described, except that the wide, thin, revolving, flexible casting belts 12 and 28 have been replaced by belts such as the belt 50 in FIG. 3 formed from a high Copper Alloy, for example, alloy UNS C19500, which nominally contains 1.5% of Iron, 0.8% of Cobalt, 0.6% of Tin, with 0.1% of Phosphorus.

In FIG. 3 is shown a portion of a wide, thin, revolving, flexible casting belt 50 passing around a belt-pulley roll 52, revolving as shown by the arrow 53, in a twin-belt moving mold 10C or 10B (FIG. 2). The lower modulus of elasticity of a Copper or high Copper Alloy belt 50 compared to the usual Carbon-steel belts affords several surprising and previously unrecognized advantages. For a given thickness, such belts undergo less bending stress on the pulleys. Further, belts of customary thicknesses always "take off" or overshoot "Y," a measurable and significant amount, as they leave a pulley, notably an upstream (entrance) pulley just as the belt approaches and enters the moving mold. Ideally, if there were no "takeoff," the belt would go in a perfectly straight, tangential path 54 from the pulley periphery into the mold itself, on the same plane as the pass line or path of the freezing mold. However, the rigidity of the metallic belt material prevents this straight tangetial path from occurring; there is always overshoot in the direction of the mold space. The takeoff "Y" in FIG. 3 is the overshoot of the belt past the plane 54 which is tangent to the pulley and parallel to the pass line.

According to our formula, the value of "Y" can be determined as follows:

$$Y = Eh^2/12DS \quad (1)$$

where "h" is the thickness of the belt, "D" is the diameter of the pulley roll 52, and "S" is the actual tensile stress in the portion of the belt concerned. The formula balances dimensionally and so will work with any set of units used consistently as for instance pounds per square inch and inches. The takeoff "Y" of a casting belt is reduced with the belt 50 made of Copper or high Copper Alloy as compared to that of Steel, because the modulus of elasticity E of Copper is barely half that of Steel. Hence, a belt 50 of such novel composition is helpful in maintaining a close, unambiguous nozzle fit in the injection feeding or closed-pool feeding of the molten metal. Some of the ambiguity in prior-art nozzle fit arises from the fact that the edges or marginal areas of a wide casting belt generally behave differently from the middle in this respect. Further, the closer approached to mold parallelism resulting from the present invention is important in presenting an undisturbed mold for the casting notably of high-Magnesium Aluminum Alloys. The advantages occur in inverse proportion to the modulus of elasticity, other factors being equal. That is, if the takeoff "Y" with a Steel belt is about 0.30 mm, a Copper belt of the same thickness on the same pulley and under the same tension will have a takeoff "Y" of only about 0.17 mm. But, if the Copper is allowed to be stressed only about 80 percent as much as Steel, then its takeoff "Y" will be about 0.21 mm. Such calculations must take into account only the local tension, not the average tension across the belt, since the belt margins, if relatively cold, will bear a greater share of the tensile force and hence be stressed "S" more, and take off less, than will the middle of the belt.

As set forth in the SUMMARY, the yield strength of a casting belt made of Copper or high Copper alloy does approach the yield strength of the typical prior-art casting belt made from standard low-carbon Steel, and thus Copper's modulus "E" in being about half that for the Steel composition of prior-art casting belts, provides yet another surprising advantage. For a given belt thickness "h," the Copper composition belt 50 undergoes less bending stress on the pulley 52 than the typical prior-art steel composition. Thus, we presently believe that high Copper composition casting belts 50 hold the future promise of actually being more durable and longer lived in commercial usage than typical steel casting belts. The Copper composition casting belt 50 has a Copper content of at least 85% Cu by weight. Some high Copper Alloys including small amounts of Iron, Cobalt and deoxidized Copper have desirable properties.

Figure 5:
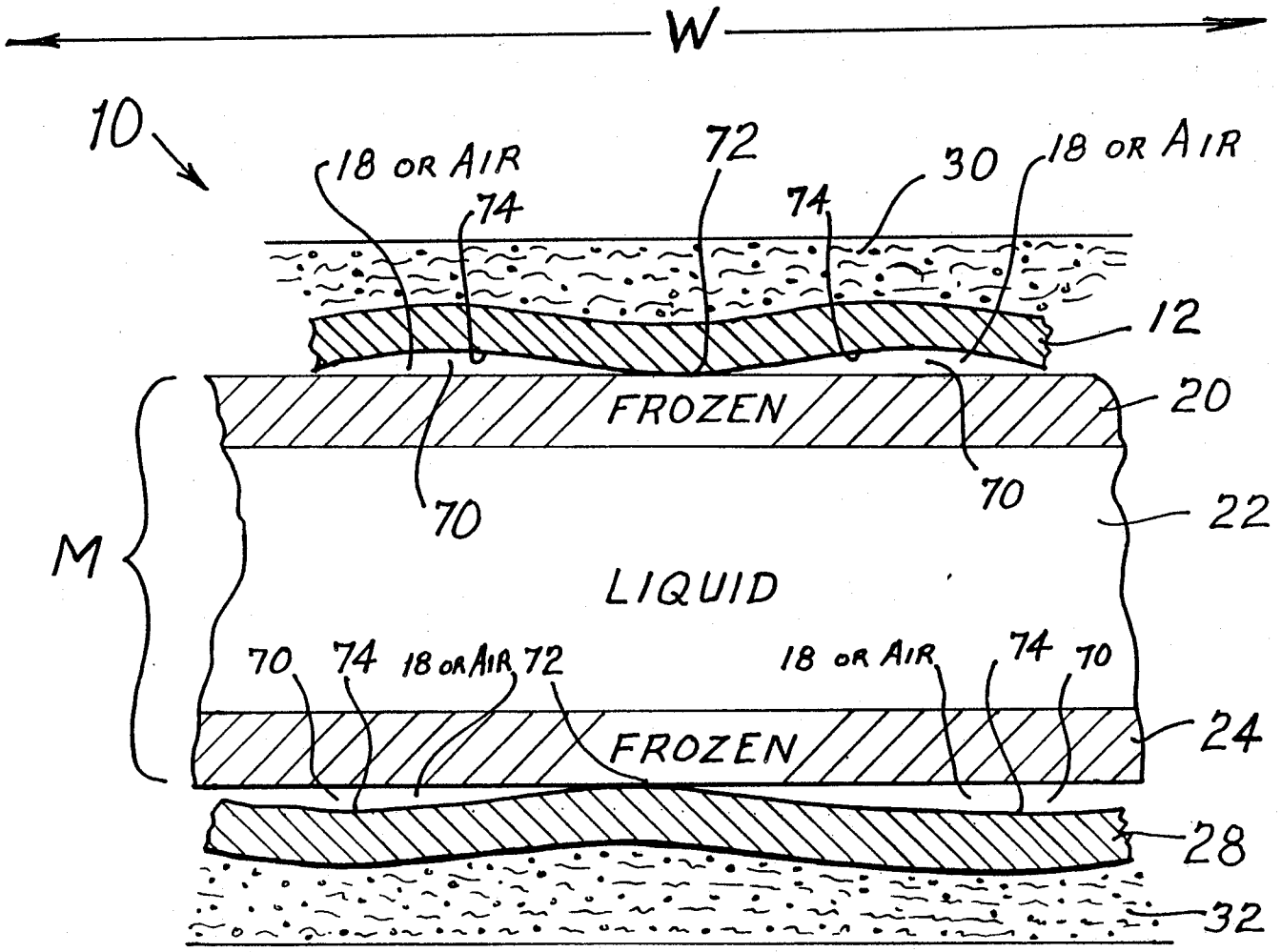
FIG. 5 (PRIOR ART)
FIG. 5 shows a schematic cross-sectional view for purposes of explanation. This is taken transversely through an upper and lower steel belt of a twin-belt continuous metal-casting machine in the moving mold near the entrance to the mold for illustrating new insights into prior-art problems which are advantageously overcome or greatly diminished by the present invention.

Another reason why we believe that such high Copper composition casting belts 50 hold future promise of more durability and longer operating lives is their higher thermal conductivity than prior-art Steel belts. Copper has a thermal conductivity "K" equal to about 3.98 watts per centimeter per degree C. temperature differential at a temperature of 27° C. (81° F.); whereas Steel has a thermal conductivity "K" equal to about 0.803 watts per centimeter per degree C. at that temperature. Thus, the thermal conductivity of Copper is about five times that for Steel, thereby advantageously resulting in a reduced temperature differential through the belt thickness "h." Thus, there are less destabilizing internal differential thermal expansion stresses across its own thickness "h" for the high Copper composition belt 50. In other words, this about 5 times as high thermal conductivity in synergistic co-action with the modulus "E" of about one-half markedly reduces the self-generated destabilizing bending moments created within the intended-planar mold-defining area "A" of the belt 50. Consequently, the thrust of thermal expansion to cause voids and flutes, as shown in FIG. 5 hereof and shown in FIG. 8 of Pat. Nos. 3,937,270 and 4,002,197 as referred to in the BACKGROUND, is markedly reduced.

Figure 4:
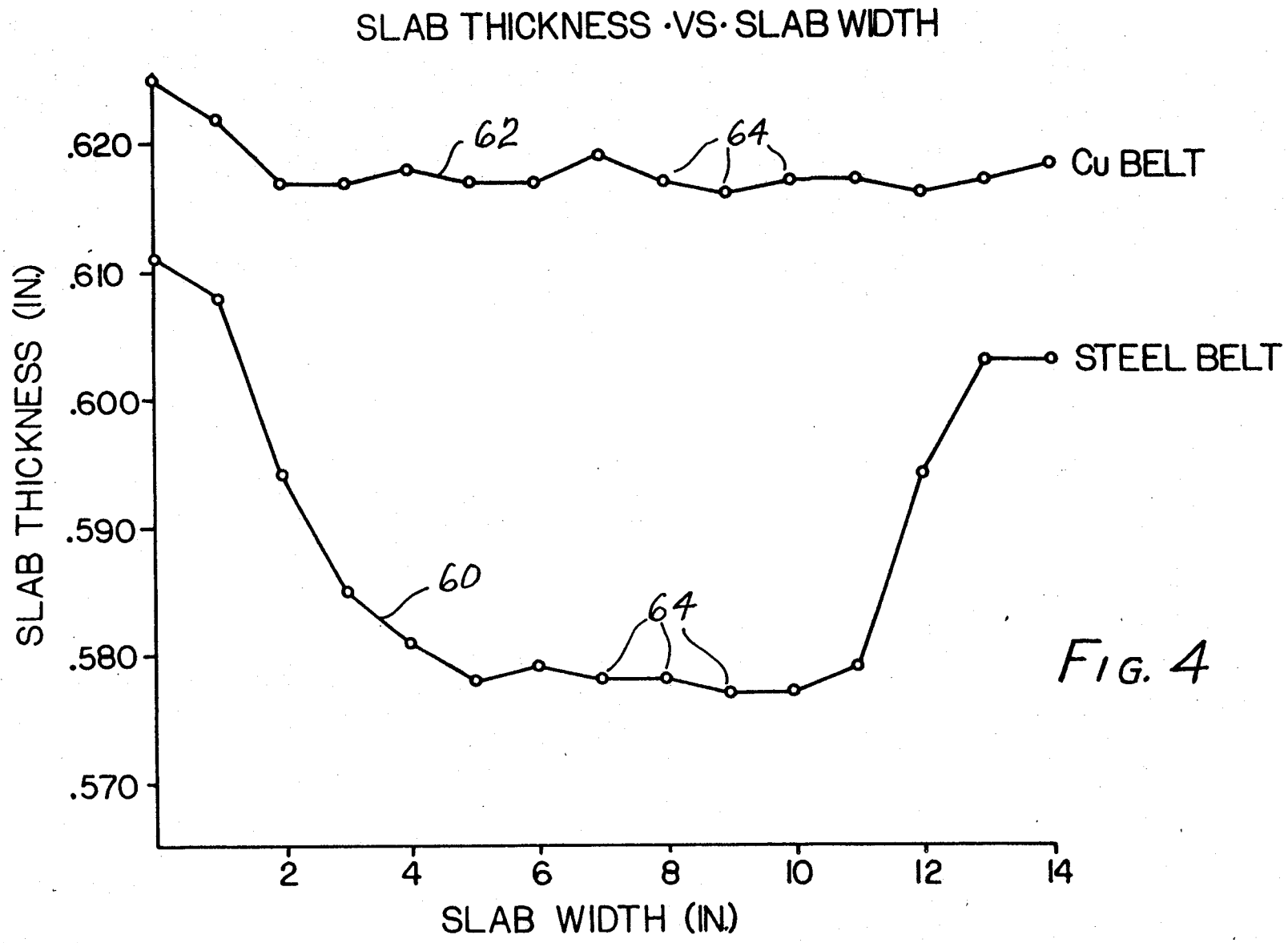
FIG. 4 shows typical plots of the thickness of a cast slab of Aluminum Alloy containing Magnesium as measured at points across the width when prior-art steel belts are used and when the novel Copper or high Copper Alloy composition belts are used.

In FIG. 4 is shown a plot 60 of the measured thickness in inches of an AA 3105 (0.5% Magnesium) Aluminum Alloy slab 14 inches (355 mm) wide cast in a twin-belt moving mold 10 (FIG. 14) having conventional Steel belts. (This AA 3105 classification designation for this Alloy is by the Aluminum Association.) Also shown in a plot 62 of the measured thickness in inches of the same width and same alloy slab cast in a twin-belt moving mold 10C having two high-Copper-composition belts 50 (FIG. 3). The thickness measurements of each plot 60 and 62 were made at fifteen measurement points 64 spaced one inch apart across the full width of the slab. For casting each of the two slabs whose thicknesses are plotted at 60 or 62, the twin-belt casting machine was arranged to have exactly the same cross-sectional area and shape of mold space when the respective two Steel and two high-Copper-composition belts were revolving, as measured at room temperature. The remarkably improved uniformity in thickness when using the high Copper composition belts 50 is immediately apparent. Moreover, this improvement was obtained without providing a Helium-containing gaseous film 18A either above or below the cast slab. A prior-art dry Nitrogen shrouding gas 18 was employed during the casting of each slab.

Inviting attention to the partial schematic cross-sectional view in FIG. 5, prior-art Steel casting belts 12 and 28 are shown in association with high velocity coolant 30 and 32 and with metal M being cast in a twin-belt moving mold 10. A skin or shell 20, 24 has solidified over a molten or liquid core 22. It is to be noted that this cross-sectional view in FIG. 5 is transverse to the casting flow, and thus the frozen layers 20, 24 are shown having an approximately uniform thickness. The belts 12 and 28 have been thermally distorted as shown in FIG. 8 of U.S. Pat. Nos. 3,937,270 and 4,002,197, thereby causing significant spaces 70 to occur between the respective belts 12, 28 and the frozen metal 20, 24 and causing areas or regions 72 of contact or closeness between the belts and the frozen metal. It is to be noted that in the prior art these spaces 70 are filled with the shrouding gas 18, if a shrouding gas is used, or else these spaces 70 are filled with Air.

In this schematic view in FIG. 5, the permanent belt coating 14 (FIG. 1) and the belt dressing 16 have been intentionally omitted in order to explain more clearly our new insight or discovery. Now, turning back to FIG. 1 and looking at the calculated temperature plots 34 and 36,it is seen that the calculated temperature drop through all four of the solid components of the moving mold (namely: belt 12, permanent coating 14, dressing 16 and even including the frozen skin 20) add up to about 220° C.; whereas, the drop through a shrouding gaseous layer 18 of Nitrogen (or through a layer of Air whose thermal conductivity is about the same as for Nitrogen) calculates as about 380° C. The total temperature drop is about 600° C., being the sum of 220° C. and 380° C. Thus, the magnitude of the temperature drop through the gaseous layer 18 by itself is about 1.73 times the magnitude of the sum total of the drops through all four of the solid components. The temperature drop through the gaseous layer 18 by itself is about 63 percent of the total overall drop of 600° C.

In summary, in the prior-art moving mold 10 as shown in FIG. 1, we believe that the major or principal portion of the total temperature drop from the molten core 22 to the outer surfaces of the casting belts takes place in the shrouding gaseous film or layer 18 (or in the Air film if an enert shrouding gas is not used). Moreover, this temperature drop through the prior-art gaseous film or layer 18 has a ratio of about 1.73 to the sum total drop through all four of the solid components in the moving mold 10. Conversely, the drop through the four solid barriers has a ratio of about 0.58 to the drop through the prior-art gaseous layer 18.

(It will be appreciated that the reason for using carefully analytically calculated estimated temperature effects is that no one, so far as we know, has devised any way to measure such temperatures in a twin-belt moving mold carrying a casting flow of molten metal.)

Now, turning back to FIG. 5, it strikes us that an undesirable positive feedback mechanism may be present due to the large magnitude of the temperature drop through the inert shrouding gaseous layer 18 (or through the Air layer if an inert shrouding gas is not used), now to be explained.

THEORIES AS TO WHY THE INVENTION WORKS

As noted above, the present invention is contrary or opposite of to what has been done in the past to meet the problems of thermal instability of the casting belts. We do not know why the use of Helium as an inert gaseous film or layer 18A (FIG. 2), or inert mixtures of it in this film or layer 18A, results in improved continuously cast Aluminum product when the Aluminum is substantially alloyed. However, we have developed three theories which fit a number of facts, which may be called (i) the equilibrium theory, (ii) the positive feedback theory, and (iii) the "lively" Helium purging theory.

The first theory holds that balance or equilibrium between the thermal resistivities of the heat-transfer gas film 18A and the three above-described solid layers of the mold wall is the "key" to the stated good results. We believe that the gaseous film 18 in the prior art is the principal portion of the total thermal barrier, as discussed above. The calculated temperature plot 34 and 36 in FIG. 1 show that the respective temperature differentials are calculated as only about 140° C. for the combined three solid mold wall barriers (belt 12, coating 14 and dressing 16), while the temperature drop through the prior-art Nitrogen heat-transfer gas film 18 is calculated as being about 400° C. In other words, the ratio of temperature drop through the prior-art gaseous film or layer 18 to the sum total of the drop through the three solid layers of the mold wall is about 2.8. That is, roughly only about 25% of the thermal gradient drop is being borne by the three combined solid components of the mold wall, while about 75 percent is being borne by the prior-art Nitrogen gas film.

By contrast, the calculated temperature plots 34A and 36A in FIG. 2 show that the Helium-Nitrogen mixture causes the total temperature drop to be distributed remarkably differently: the respective temperature differentials are calculated as about 220° C. for the combined three solid mold wall barriers (belt 12, coating 14 and dressing 16), while the temperature drop through the novel gaseous film 18A is calculated as being lowered to about 260° C. In other words, the ratio of the temperature drop through the novel gaseous film or layer 18A to the sum total of the drop through the three layers of the mold wall is about 1.2, which is less than about half the ratio occurring in the prior art. Consequently, there is a nearer approach to a balance or to parity or to equilibrium in thermal drop (thermal gradient) sharing, as between the solids of the mold wall and the novel gaseous film 18A. Roughly about 45% of the total thermal drop is now being borne by the combined solids and roughly about 55% is being borne by the gaseous film layer 18A, a change which we believe to be desirable in accordance with our equilibrium theory.

Moreover, taking a critical look at the difference of the curves 34A and 36A as compared with the respective curves 34 and 36, it is seen that in FIG. 2 the belt coating 14 and belt dressing 16 are now bearing a much greater proportion of the total thermal gradient than in FIG. 1, namely, about 1.6 times as much. By virtue of using the novel heat-transfer gaseous film or layer 18A, the protective layer 14 and 16 are being forced to do their job of protecting the casting belts. Now, as seen from the curves 34A and 36A, there is roughly an equilibrium between the amount of thermal drop occurring in the belt 12, the coating 14 and dressing 16, as compared to that occurring in the gaseous layer 18A, which we believe to be desirable in accordance with our equilibrium theory.

The use of high Copper composition belt 50 together with the heat-transfer gaseous film or layer 18A in the twin-belt moving mold 10B (FIG. 2) will cause the thermal drop occurring in the coating 14 and 16 to become more dominant than that occurring when using a steel belt and the prior-art gaseous layer 18, as described above in connection with achieving of equilibrium. Thinking beyond the equilibrium theory, it is possible that further evidence may lead us to conclude that when the thermal gradient drop across the three solid layers of the mold wall 12, 14, and 16 exceeds the thermal gradient drop through the gaseous layer 18A, the result may be more advantageous than achieving a state of equilibrium of the respective thermal gradients.

The second theory, regarding positive feedback, requires a longer explanation and pivots on our appreciation for the relatively high thermal conductivity (low thermal resistivity) of the novel heat-transfer gaseous film or layer 18A compared with the relatively low thermal conductivity (high thermal resistivity) of Air, Nitrogen, Argon or Carbon Dioxide, plus our new insight or discovery regarding the implications of FIG. 5. This positive feedback theory holds that there appears to be at work an inherently unstable thermomechanical process. The moving metallic casting belt 12 or 28 (FIG. 5) is highly tensed longitudinally in operation. The resulting condition across the belt in the direction of the belt width "W" in FIG. 5 is in effect that of a thin column being subjected to compressive loading. Consequently, the column 12 or 28 is potentially unstable, being subject to buckling or fluting. The destabilizing compressive (sideways) load in the transverse direction "W" arises from the fact that the marginal areas of the belt are normally cold. "Cold framing" is the phenomenon whereby the thermal expansion of the casting belt opposite hot metal 20, 22, 24, not only causes distortion in the upstream interior belt areas, as shown in FIG. 8 of U.S. Pat. Nos. 3,937,270 and 4,002,197 discussed in the BACKGROUND, but also causes tension to be transferred to the cold edges or margins, thereby tending to leave the heated middle belt areas slack and apt to distort. The relatively cooler and more highly tensed edges act in effect as immovable mechanical barriers in the width direction "W" and therefore confine the expansion of the heated middle portion of each belt, causing the middle portion of the belt to be subjected to compressive loading in the width direction "W" (FIG.5).

The initial thermal shock effect of molten metal contacting the casting belt along the upstream line of initial contact inevitably causes some local buckling, warping, fluting or puckering of the casting belt, as shown in FIG. 8 of Pat. Nos. 3,397,270 and 4,002,197 referenced above several times. If the warp at any given point on the belt should level out promptly as the belt revolves, and before a rigid skin 20, 24 of molten metal 22 becomes frozen as shown in FIG. 5, then the casting may go well. But if not, warpage, distortion in the belts as shown in FIG. 5 (plus possible resulting ripples in the frozen skin 20, 24) spoil most of the contact with the belt thenceforth. Separation spaces 70 begin to form (FIG. 5), and they become filled with Air or shrouding gas 18. Air, or Nitrogen by itself or Argon by itself, or Carbon Dioxide by itself, are all highly insulative. If they are present in spaces or gaps 70 of varying thicknesses at different points, the thermal resistivity across the moving mold wall varies correspondingly and significantly. These local differences in thermal resistivity are mirrored as local differences in heat flux; that is, the less the resistivity, the more the heat flux. The heat flux differences are further mirrored as differences in the local temperatures of the casting belt 12 or 28: the more the heat flux, the higher the temperature of the casting belt, especially on the side nearest the hot metal. Thus, the convex localized belt areas, such as convex areas 72 in FIG. 5, will become hotter than the concave localized belt areas, such as concave areas 74 in FIG. 5.

With randomly higher localized belt temperatures go corresponding thermal expansions and localized belt distortions. A small local expansion in a flat belt 12 or 28, especially when mostly toward one surface as shown at 72 in FIG. 5, causes localized distortions or flutes or "pops" or ridges or domes, such localized effects being of surprising amplitude, with correlative concavities or valleys as at 74 in FIG. 5.

These localized thermo-mechanical distortion warping effects are believed to be magnified through an unstable enlarging spiral of adverse events which constitute positive feedback. The creation of the localized domes or ridges 72 and localized valleys 74 results in still thicker localized thermal barriers of Air or shrouding gas 18 in the enlarging spaces or gaps 70 in the same places that had already begun to form. In the local regions 70, the heat flux decreases; consequently, the belt cools in the localized concavities 74, thereby contributing further to the disparities, since the localized convex regions or ridges 72 of the belt remain hot or become hotter. These increasing disparities lead to still larger concavities or hollows (valleys) 74, thereby levering the concave areas 74 of the belt 12 or 28 still farther away from the freezing metallic product 20 or 24, with the localized high spots 72 acting as the fulcrums for these levering effects.

Consequently, the process is one of positive feedback: the more the disparities, the more that the concavities or hollows 74 of the belt 12 lever themselves away from the freezing product 20. This adverse spiral of destabilizing thermo-mechanical dynamics continues and culminates perhaps in longitudinal flutes or valleys as indicated at 74 in FIG. 5. In fact, the up-and-down belt movement between ridges 72 and valleys 74 may be anything up to 3 mm (⅛ of an inch) in extreme cases. The quality of the resulting cast product M is correspondingly adversely affected.

But when the Helium-containing gaseous film or layer 18A (FIG. 2) is substituted for the prior-art inert shrouding layer 18 of Air in FIGS. 1 and 5, the effects of the gap variations or spaces 70 on localized thermal resistance, localized heat flux and localized belt temperatures become dramatically reduced. Consequently, the thermo-mechanical effects across the width of the twin-belt moving mold 10A or 10B become remarkably more uniform, and the belt becomes advantageously stabilized in flatness.

Our theory is that the provision of the Helium-containing gaseous film or layer 18A dramatically reduces the possible range of variations in thermal resistance, and therefore the prior-art enlarging instability spiral of adverse events is arrested or almost completely prevented; i.e. the undesirable positive feedback explained above is essentially forestalled, inhibited or prevented, or at least it is greatly diminished. Since the thermal resistance of Helium is about 1/6th that of Air, about 2/13ths that of Nitrogen, about 10/87ths that of Argon and about 1/11th that of Carbon Dioxide, then advantageously the thermal resistance of the Helium-containing gaseous film or layer 18A does not change very much in absolute magnitude with changes in its thicknesses. Thus, the spaces or gaps 70 no longer expand so far as to cause a significant locus of heat-transfer deviation sufficient to warp, ripple or flute the casting belt. Local variations in the mold that formerly triggered progressively enlarging instability are now suitably arrested. The range of adverse interfacial thermo-mechanical interactions and reactions between the moving wide, thin, flexible belt 12 or 28 and the freezing metal 20, 22, 24 are circumscribed and controlled. Therefore, our conclusion is that the gaseous film or layer 18A should be inert and as highly thermally conductive as reasonably practicable in order to stabilize the thermo-mechanical dynamics of the moving mold 10A or 10B as much as practicable, and hence our conclusion is that a Helium-containing gaseous film or layer 18A should be provided, and our conclusion has proven true to date in trials.

Moreover, our third theory is that Helium is a "lively," highly effective purging gas. The high thermal conductivity of Helium is itself related to the high speed of the gaseous atoms of this element. This high thermal conductivity is apparently compounded by the fact that the innate liveliness and smallness of th atoms of Helium enable them to be highly efficient in entering into the accessible pores of the permanent coating 14 for displacing or purging or scouring away other prior-art gases entrained in this porous coating—gaseous that we have concluded to be undesirable, because they are antagonistic to stability of the twin-belt moving mold. The Helium-containing gaseous film or layer 18A advantageously acts and performs like a stabilizing and highly thermally conductive layer in contrast to the destabilizing prior-art thermally resisting inert shrouding gas 18 or Air.

Regardless of whether our theories are correct, the provision of the Helium-containing gaseous film layer 18A has yielded some surprisingly favorable results in trials, as discussed below.

SPECIFIC IMPROVED RESULTS OF EMPLOYING THE INVENTION

In order to appreciate the specific improved results of employing the invention, it is believed that it will be helpful to the reader to know some of the characteristics of continuously casting of Aluminum Alloys in a prior-art twin-belt mold 10. Even slight changes in Aluminum alloying or in the conditions of casting can induce large differences in quality of the cast product. We believe the main reasons are the stability or non-stability of the belts and the arresting of distortion of the belts under the stimulus of casting. The effects of alloying can be demonstrated in terms of the standard metallurgy of one class of Aluminum Alloys. When the Magnesium content in an Aluminum slab is below 1.8 percent, the Magnesium is contained in stable solution before freezing and is locked in solid solution thereafter, where it contributes to the desired increase in hardness and strength. Moderate changes in the stability parameters of the casting belts when casting Aluminum in this alloy range below 1.8 percent Magnesium are much less troublesome than over 1.8 percent.

But when the Magnesium content of Aluminum Alloy is increased above 1.8 percent, a metallurgy condition is entered in which, in the molten state, some of the Magnesium is present in various transient or semi-stable compounds with the Aluminum or with other alloying elements which may be present. In general, the compounds or solutions differ in density among themselves and so tend to segregate while molten. These constituents freeze at different temperatures. Freezing ranges of over 40° C. are encountered in some of these commercial alloys. The longer the freezing takes, the more the segregation. To give an analogy, if you are to freeze a mixture of pea soup, tomato juice, and clam chowder while desiring a homogenous result, you must, after stirring, do the freezing quickly and finally, before the various constituents have time to float or sink, or be sweated out from slowly frozen material. But when freezing is slow or hesitant, there is segregation of secondary phases, i.e., segregation of eutectoid quasi-chemical compounds containing disproportionate amounts of alloying elements, which are apt to function as hardeners. Slow freezing is generally evidenced by coarse or non-uniform grain size. Less subtly, porosity and surface sweating or remelting (liquation) are detectible in and near the surfaces. The eutectoids ultimately refreeze, but when rolled later, their hardness or their residual liquid content may cause still less subtle problems of smears, silvers, laminations, and breaks.

In the case of some Aluminum Alloys containing over 1.8 percent Magnesium, as in most of the AA 5000 Aluminum Alloys, fast and uniform freezing rate is signaled, metallurgically speaking, by an average dendritic cell size of about 10 micrometers (0.0004 inch) in the region within 1.25 to 2.5 mm (0.050 to 0.100 inch) beneath the principal surfaces. Our tests indicate that, by employing the present invention, the product should have these desired characteristics. (For definition of dendritic cell size see R. E. Spear and G. R. Gardner, "Dendrite Cell Size," in American Foundrymen's Society Transactions, 71, 1963, 209–215.)

Aluminum tonnage output per hour on a given twin-belt casting machine casting AA 3003 alloy has been increased to date by about 30 percent by the substitution of dry Helium 18A (FIG. 2) for dry Nitrogen 18 (FIG. 1). It is to be noted in this discussion that AA refers to the classification of the Aluminum Association.

In casting AA 5052 Aluminum alloy (2.5% Magnesium) with a dry inert gaseous film 18A, a mixture of at least 20% Helium by volume with balance of substantially all Nitrogen, serving as a heat-transfer gaseous film 18A, a slab of very good quality was produced despite the solidification temperature range of this Alloy being 42° C. whereas in prior-art casting with a dry Nitrogen gaseous shrouding film 18, tiny cracks were previously experienced.

In casting AA 6061 Aluminum Alloy with a dry inert gaseous film 18A containing at least 20% Helium by volume, and the balance substantially all Nitrogen, serving as a gaseous heat-transfer film 18A, a large improvement in surface appearance was made, despite the solidification range of this Alloy being 70° C.

While casting an Aluminum Alloy of the AA 3000 series, the substitution of a dry Helium-containing gaseous film 18A containing at least 20% by volume of Helium serving as a heat-transfer gaseous film 18A in place of Nitrogen shrouding gaseous film 18 resulted in a lowering of the exit temperature of the Aluminum slab at an average of 55° C., while casting at the same casting flow rate.

In casting Zinc slab employing a dry gaseous film of Helium 20% by volume with the balance Nitrogen, serving as a heat-transfer gaseous film 18A the exit temperature was lowered from 600° F. to 425° F. (315° C. to 218° C.) compared with using a dry Nitrogen shrouding gaseous film 18, other predetermined parameters being unchanged.

AA 3105 (0.5 percent magnesium) Alloy of Aluminum was cast 355 mm (14 inches) wide (FIG. 4) in a twin-belt moving mold 10B using high-Copper composition belts 50 having a permanent matrix belt coating 14 of 26 fusion-bonded thereto. An inert dry shrouding gaseous film 18 of substantially all dry Nitrogen was used during the casting run. Exit temperature was around 60° C. lower for a given speed of casting, and the "spread" or range of temperature difference was less than 35° C. across the slab, as compared with more than twice that range formerly when using prior-art Steel casting belts 12 and 28 with an inert dry shrouding gaseous film 18 of substantially all dry Nitrogen. Moreover, visual surface quality demonstrated that relatively even heat transfer had occurred at all points across the width of the cast slab; the surfaces of the Aluminum Alloy slab were more shiny and improved (plot 62) over results obtained (plot 60) with Steel belts. The Aluminum Alloy slab shape when thus cast on the high Copper composition belts 50 was consistent and substantially flattened, in comparison to the sinks (plot 60) which often occur using Steel belts when casting high Magnesium Aluminum Alloys.

In each of the above cast products, the metallurgy was improved and the surface appearance of the cast product was improved from what would have occurred in the same Alloy cast in the prior-art mold 10 (FIG. 1). A further result of employing the invention is that the exit temperature across the width of an emerging slab product is substantially more uniform; i.e. the range of temperature difference across the width is reduced, and so improved, with the use of the Helium-containing gaseous film or layer 18A above and below the cast metal M'. This substantial uniformity in the temperature profile, as the cast slab exits, in turn facilitates the immediate in-line rolling of the cast product, thereby achieving consistent and uniform results in both enhanced product output and quality. The invention enables increased latitude for casting Alloys having wider ranges of solidification temperature and will enable increased speeds of twin-belt casting of metals generally.

DISCUSSION OF FURTHER ADVANTAGES OF THE INVENTION

By continuous infra-red (or visual-light) radiation monitoring of the temperature profile of a cast metal product M' as it exits the moving mold 10A or 10B or 10C, the optimum control of the critical range of freezing can be gauged and measured. Then, the operators can manually or automatically control the Helium percentage content and composition of the inert gaseous film or layer 18A above and below the cast product for achieving optimum results. Generally, the faster the metal freezes in the mold, the cooler the product is when it emerges, other things being equal. Conversely, the slower the freezing rate, the hotter the product is apt to be when it comes out. While it is possible to adjust the speed of the moving mold 10A or 10B defined by the endless flexible belts in response to the exit temperature of the product in order to control that temperature, it is usually better for practical reasons including upstream metal-feeding and downstream rolling to retain the speed of the moving mold at an optimum, non-fluctuating rate, once a cast is well under way. Adjustments in regulating this freezing rate, so that an acceptable range of non-fluctuation of casting rate results, can advantageously be made by adjusting the proportion of Helium to Nitrogen in the mixture applied as a heat-transfer gaseous layer or film 18A. As a refinement of the present invention, the rate of freezing of molten metal M' within the mold 10A or 10B is adjusted to an optimum rate by varying the blending of the Helium with, for example, Nitrogen or Argon or Carbon Dioxide.

As a further development of the present invention, two different mixtures of Helium-containing gas each including at least one other inert gas may be employed, in such a way that one mixture becomes entrained with one mold surface 14, 16 of a continuous casting machine, and the other is principally directed at, and becomes entrained with, the other mold surface 26. In the case of an inclined or horizontal twin-belt casting machine, this refers to the top or upper belt 12 or 50 and the bottom or lower belt 28 or 50, the latter of which is especially affected by gravity since it bears the weight of the metal M' being cast. The result is that the relative heat transmission of said two (top and bottom) gaseous film interfaces 18A can be suitably adjusted, so as to obtain a substantial state of heat transfer equilibrium in the continuously moving mold. By means of the indirect method and apparatus of applying inert gas to the upper and lower belts, as described in connection with FIGS. 3, 4 and 9 of U.S. Pat. Nos. 4,593,742 and 4,648,438, this procedure of applying different Helium-containing gaseous film mixtures to the two belts can be performed while casting is in progress.

A variation of the above-described differential mixtures of gases is that of mixing the Helium gas notably for application to the lower belt of a twin-belt casting machine near the mold entrance with Argon or with Carbon Dioxide which are both relatively heavy gases, or with some other heavy inert gas. If the mixture is heavier than Air, it will not tend to escape upward, in contrast to the inherent levity of pure Helium or of Helium mixed with Nitrogen. Suitable variations may be tailor-made and utilized under conditions in a way hitherto not possible. Theoretically, for example, in open-pool feeding, such a suitably "heavy" gas mixture could even prove of some benefit as a thermal control, as well as serving as a shrouding gas. Open-pool feeding is defined as an arrangement in which sealed or semi-sealed molten metal injection devices are not employed but rather in which the metal is poured into a pool of molten metal on the lower belt, the pool having an exposed free surface facing toward the upper belt.

By virtue of the enhanced heat transfer provided by the Helium-containing gaseous film or layer 18A above and below the metal M' being cast, there is a significant increase in speed of casting of metals in general. This increased casting speed in turn results in higher-quality metallurgy as well as in higher output in gross finished tons. This advantageous increase in speed may afford the opportunity for the future use of conventional tandem hot mills directly in line with a twin-belt continuous casting machine in casting of ferrous metals. Such rolling mills require a constant high output of ferrous metal at a minimum linear speed on the order of 9 to 12 meters (30 to 40 feet) per minute at a thickness in the range of about 25 to 51 mm (1 to 2 inches).

Although the invention has been described herein as initially being tested on Aluminum Alloys and a Zinc Alloy, it is believed to be applicable to casting of any metals or alloys that may be continuously cast on belts.

As used herein, the term "being inert" or "inert" means being essentially inert with respect to the metal being cast under the conditions occurring in the moving casting belt mold.

Although specific presently preferred embodiments of the invention have been disclosed herein in detail, it is to be understood that the examples have been described for purposes of illustration. This disclosure is not to be construed as limiting the scope of the invention, since the described methods may be changed in details by those skilled in the art, in order to adapt these methods of casting metal shapes to be useful in particular continuous casting machines or situations, without departing from the scope of the following claims.

I claim:

1. A wide, thin, endless, flexible twin-belt-casting-machine casting belt for use in continuously casting metal product directly from molten metal in a continuous metal casting machine, said casting belt having a high Copper Alloy belt composition containing at least 85% Copper by weight and having a Young's modulus of elasticity in the range of about 15 to about $18\times10^6$ lbs. per square inch.

2. A wide, thin, endless, flexible casting belt as claimed in claim 1, in which:

said casting belt has bonded thereto a permanent insulative belt coating having fluid-accessible porosity.

3. A wide, thin, endless, flexible casting belt as claimed in claim 1, in which:

said high Copper Alloy belt composition contains by weight about 1.5% of Iron, about 0.8% of Cobalt, about 0.6% of Tin and about 0.1% of Phosphorous.

4. A wide, thin, endless, flexible casting belt as claimed in claim 1, in which:

said belt has a thermal conductivity of about 3.98 Watts per centimeter per degree C. temperature differential at a temperature of about 27° C.

5. For use in a twin-belt casting machine wherein first and second wide, thin, endless, flexible metallic casting belts having thickness in the range from about 0.035 of an inch (about 0.89 mm) up to about 0.065 of an inch (about 1.65 mm) are moved under tension forces higher than 10,000 pounds per square inch of belt cross-sectional area for providing respective first and second spaced, opposed walls of a moving mold for continuous casting of metal product from molten metal, and wherein the front face of the respective belt faces toward the moving mold and reverse face of the respective belt is cooled by liquid coolant, and wherein flatness of each casting belt is important, an improved twin-belt-casting-machine casting belt formed from a metallic composition containing at least 85% Copper by weight and having a Young's modulus of elasticity in the range of about 15 to about $18\times10^6$ lbs. per square inch (about 10.3 to about $12.4\times10^6$ Newtons per square centimeter), thereby remaining flatter along the moving mold than prior steel casting belt of the same size.

6. For use in a twin-belt casting machine, an improved casting belt as claimed in claim 5, in which:

said metallic composition has a thermal conductivity of about 3.98 Watts per centimeter per degree C.

temperature differential at a temperature of about 27° C.

7. For use in a twin-belt casting machine, an improved casting belt as claimed in claim 5, in which:

the front face of said improved casting belt has bonded thereto a permanent insulative belt coating having fluid-accessible porosity.

* * * * *